US005842881A

United States Patent [19]

Ecker et al.

[11] Patent Number: 5,842,881

[45] Date of Patent: Dec. 1, 1998

[54] SUBSTRATE-EMBEDDED PLUGGABLE RECEPTACLES FOR CONNECTING CLUSTERED ELECTRICAL CABLES TO A MODULE

[75] Inventors: Mario Enrique Ecker; Lawrence Jacobowitz, both of Poughkeepsie; Casimer Maurice DeCusatis, Lake Katrine, all of N.Y.

[73] Assignee: International Business Machines Corporation, Armonk, N.Y.

[21] Appl. No.: 101,121

[22] Filed: Aug. 3, 1993

[51] Int. Cl.[6] ..... H01R 9/09

[52] U.S. Cl. ..... 439/329; 29/825; 333/260; 439/347

[58] Field of Search ..... 439/55, 79, 80, 439/329, 347; 385/88, 90, 94, 92, 49; 333/260, 156, 160, 243; 29/830, 846, 825, 842, 876

[56] References Cited

U.S. PATENT DOCUMENTS

| | | | |
|---|---|---|---|
| 4,322,127 | 3/1982 | Comerford et al. | 385/65 |
| 4,553,813 | 11/1985 | McNaughton et al. | 385/89 |
| 4,553,814 | 11/1985 | Bahl et al. | 385/86 |
| 5,155,786 | 10/1992 | Ecker et al. | 385/94 |
| 5,173,668 | 12/1992 | Jacobowitz et al. | 333/156 |
| 5,212,754 | 5/1993 | Basavanhally | 385/88 |
| 5,333,225 | 7/1994 | Jacobowitz | 385/93 |
| 5,337,388 | 8/1994 | Jacobowitz | 385/89 |

*Primary Examiner*—Neil Abrams
*Attorney, Agent, or Firm*—Bernard M. Goldman

[57] ABSTRACT

A pluggable connector capable of connecting a large number of electrical transmission lines per connector, and small enough to enable a large number of connectors to be added to a multi-chip module. For example, 5 or 6 of these connectors can add over a hundred coaxial cables to a module. Improved I/O communications is added to a module by such coaxial cables, since they can communicate very high frequency signals in noise prone environments. The pluggable connector is embedded in a multilayer module (e.g. ceramic or glass) for conveying digital information to transmission lines internal or printed on the surface of a module. Each connector contains a receptacle 19 having a silicon contact structure embedded in an edge of a multi-chip module. The contact structure is formed with a plug-receiving angle for deflecting multiple cantilevered plug contacts 17 into engagement with corresponding receptacle contacts 22. The silicon connector parts 19 have a thermal coefficient of expansion which matches that of silicon semiconductor and glass ceramic module 4 to maintain alignment over large temperature variations.

16 Claims, 4 Drawing Sheets

SUBSTRATE-EMBEDDED PLUGGABLE RECEPTACLES FOR CONNECTING CLUSTERED ELECTRICAL CABLES TO A MODULE

CROSS REFERENCED PATENT APPLICATIONS and PATENTS

This patent application is being filed concurrently with the following related patent applications: U.S. Pat. No. 5,333,225 entitled "Substrate-Embedded Pluggable Receptacles For Connecting Clustered Optical Cables To A Module", Ser. No. 08/101,120 entitled "Pluggable Connectors For Connecting A Module To Large Numbers of Electrical and/or Optical Cables Through A Seal", U.S. Pat. No. 5,337,338 entitled "Matrix of Pluggable Connectors for Connecting Large Numbers of Clustered Electrical and/or Optical Cables to a Module". Inventorship and assignee of each of these related applications is the same as the inventorship and assignee of the subject application.

Previously filed pertinent applications and issued patents by some of the joint inventors on the subject application include: U.S. Pat. No. 5,241,614 entitled "Apparatus and a Method for an Optical Fiber Interface" by L. Jacobowitz and M. E. Ecker, and, U.S. Pat. No. 5,304,969 entitled "Apparatus and a Method for an Electrical Transmission-Line Interface" by M. E. Ecker and L. Jacobowitz, U.S. Pat. No. 5,155,786 entitled "Apparatus and a Method for an Optical Fiber Interface" by L. Jacobowitz and M. E. Ecker, and U.S. Pat. No. 5,173,668 entitled "Apparatus and a Method for an Electrical Transmission-Line Interface" by M. E. Ecker and L. Jacobowitz.

The disclosures of all of the above applications and patents are incorporated by reference herein.

INTRODUCTION

This invention relates to apparatus and methods for embedding one or more electrical receptacles into one or more edges of a module substrate. Each connector is capable of connecting a large number of high bandwidth electrical lines to the module. The module housing supports adjustment means for aligning a plug in each receptical.

BACKGROUND OF THE INVENTION

In prior modules, the number of I/O (input/output) connectors per module is constrained by the inability of prior connectors from being mounted on narrow edges of modules. Current widely used modules include thermal conduction modules (TCMs), which have a thermal cooling structure mounted on the upper major surface, and pin I/O connectors mounted on their lower major surface. These pin connectors cannot also be mounted on the edges of the module due to the structural constraints. The pin I/O connectors are sometimes called harcon connectors, and they suffer from high inductance which limits the bandwidth available from these pin connections, and they are not readily adaptable for connection to high bandwidth cables, such as coaxial cables.

Prior art connectors, such as disclosed in U.S. Pat. No. 4,553,813 (McNaughton et al), do not disclose any multi-transmission-line array connector, nor any alignment means feasible for an array connector. Also, U.S. Pat. No. 4,553,813 does not provide any connector which can intermix different types of transmission lines, such as optical and electrical, or intermix different types of array connectors for the same module. The connector type in U.S. Pat. No. 4,553,913 does not connect to a large number of transmission lines, such as is connectable by the connector in the subject invention.

In this specification, the term "module" includes several levels in a package, as follows: A "substrate" is the innermost part of a module; in the preferred embodiment the substrate is primarily silicon or glass-ceramic. A "chip carrier" is a substrate having semiconductor chips placed thereon in a module, and the chip carrier is a higher level of packaging than the substrate. A "housing" is a frame around the chip carrier to seal or protect the chip carrier and is the outer-most part of a module. In the preferred embodiment described herein, the "module" encompasses a substrate, a chip carrier, and a housing, although at times the term module may be used to refer to one of these parts. A module may be refer to as either a single-chip module or multi-chip module (MCM) according to whether its contained chip carrier has single or multiple chips (i.e. a module may contain one or more chips). An example is the commercially-used thermal conduction module (TCM) constructed with alumina substrates, which is a form of MCM. An upper major surface of the TCM is covered with a thermal cooling structure, and the other major surface is covered with conductive I/O (input/output) pins which are used to plug the module into a computer framework. The substrate in a TCM is constructed with many internal layers of wiring to accommodate the interconnections among multiple chips on the upper substrate surface. The TCM has a thin, low profile shape to support internal cooling in the TCM. Direct contact heat sinks are used. The low profile chip carrier in the module having small edge surfaces compared to the top and bottom surfaces of the chip carrier. The module does not have sufficient area on any surface to provide a desired number of conventional pin-in-hole type connectors, and the narrow edges of the TCM do not contain any conductive I/O pins.

SUMMARY OF THE INVENTION

This invention provides a unique connector having a receptical and plug providing matched impedance connections to a multiplicity of electrical cables. The preferred embodiment of the invention employs a unique receptical comprising a silicon contact actuation structure soldered in an indentation along an edge of a module substrate, and the receptical contacts are connected directly to wiring in the substrate (which connects to one or more electronic chips on the substrate) which may be a thermal conduction module (TCM) type of multilayer module (MCM) having a ceramic substrate.

This invention enables a significant increase in the number of I/Os for a module (and particularly for a TCM type of module) by supporting pluggable connectors in a housing around an module and using through-the-seal wiring between the housing mounted connectors and the module, in which the wiring passes through a seal protecting the module, from outside contamination. The connector receptacles may be permanently fastened to the module housing. A significant advantage of this arrangement is that the housing-mounted connectors do not take up space within the module (where available space may be non-existent since it is required for chip attachment or other functions), enabling a large number of additional I/O connectors to service the module. Each of these connectors is a multi-line connector which connects a large number of transmission lines.

Each of the transmission lines in a connector provides at least one effective I/O connection to the module, so that a large number of effective I/O connections can be provided to the module by a single connector; the effective number of I/Os is the number of transmission lines per connector multiplied by the number of connectors. Where modulation techniques are used to enable an single transmission line to handle multiple parallel signals, a single transmission line may provide a plurality of effective I/O connections for the module.

With this invention, each of the housing-mounted multi-transmission line connectors may connect to either electrical or optical transmission lines, or any of these connectors may be a hybrid connector for connecting a combination of electrical and optical transmission lines to the MCM. All of the housing-mounted multi-transmission line connectors of an MCM may provide the only connectors for an MCM, or they may be supplemental connectors for an MCM also having conventional pin connectors (such as on its bottom). These housing-mounted connectors may be used for data signals, clock signals, other types of signals, or for power distribution.

These connectors are each comprised of a connector receptacle located in the wall of an MCM housing, and a receptacle which receives a disengagable plug supporting an array of transmission lines. The plugs may be disengaged at any time and re-plugged into different connector receptacles in an MCM's housing to reconfigure the transmission lines to the MCM. MCM testing is enhanced by unplugging all except one plug having its transmission line signals tested, which can greatly simplify the testing of failures in an MCM.

A preferred embodiment employs unique silicon receptacle structures mounted on a housing around an MCM which is sealed within the housing by an elastic (or elastomeric) seal between the MCM and the housing. Each housing-mounted receptacle is coupled to the MCM by a flexible fiber and/or electrical transmission line which passes through the elastic seal to an electrical connection or optical interface in the MCM. A relatively large number of optical and/or electrical transmission lines can be handled by each receptacle. A disconnectable plug engages the receptacle and supports a multiplicity of cables containing a plurality of transmission lines that are then connected to the MCM through aligned corresponding transmission lines in the receptacle.

A preferred embodiment of the invention employs a unique embedded receptical having a silicon contact actuation structure with printed wiring and cantilevered controlled contact deflection and alignment means.

FEATURES OF THIS INVENTION INCLUDE

1. A pluggable contact cluster having a small linear contact pitch, for example 9 mils.

2. A pluggable contact member with precise actuation and retention means for a large cluster of electrical transmission lines, such as 27 coaxial cables per connector.

3. A pluggable contact member for impedance matching a large number of electrical transmission lines, such as connecting the signal lines and ground shields of a large number of 50 ohm miniature semi-rigid coaxial cables to appropriate cantilevered contactors with minimum characteristic impedance mismatch.

4. A pluggable contact member capable of insertion through the side of current thermal conduction modules and engaging a corresponding embedded member in a multilayer ceramic substrate and conveying digital information to printed transmission lines internal or on the surface of said substrate.

5. An embedded silicon contact structure along the edge of a multi-chip substrate capable of deflecting multiple cantilevered contactors with suitable resultant contact wipe and Hertz stress levels.

6. The capability to accommodate 5 or 6 embedded silicon contact actuation structures per edge of current size thermal conduction modules with up to 135 to 162 miniature 50 ohm semi-rigid coaxial cables/edge.

7. A means for supplementing the number of pin-in-hole socket type contacts on the bottom surface of the substrate or accommodating noise sensitive digital signal nets.

8. A pluggable connector compatible with a low thermal conduction module profile due to use of an integral fluid cooled cold plate.

OBJECTS OF THIS INVENTION ARE

1. To provide a pluggable matched impedance connector for multi-chip ceramic modules and semi-rigid coaxial cables, twisted pairs, discrete wire or flexible printed circuits.

2. To embed a member of the pluggable connector along the edges of a multilayer ceramic substrate so as to have no physical influence on the chip mounting area and cooling means of the module package.

3. To utilize preferentially etched silicon-chip-like elements to precisely align, mate and actuate densely spaced electrical contact elements.

4. To provide for a multiplicity of pluggable connector members along the edges of multi-chip module as a supplemental connection set or for use with noise sensitive intra module nets.

5. To provide means for aligning and precisely controlling insertion distance and deflection range of a multi-tier cantilever contact group.

BRIEF DESCRIPTION OF DRAWINGS

The invention may best be understood with reference to the accompanying drawings in which.

DETAILED DESCRIPTION OF THE INVENTION

The pluggable coaxial cable connector of this invention is partially integrated along the edge of substrate 4 and, except for narrow rectangular shaped openings located along the sides of the substrate, it is not discernible. Embedding the connector receptacle in the substrate provides short paths to internal substrate wiring, passes under a perimeter housing seal of a TCM, locates the pluggable member receiving slot external to the sealed module environment and is optimally placed for a low profile side entry connector application.

The precision necessary to fabricate and actuate a coaxial connector with an effective linear contact pitch of 9 mils is dependent on preferentially etched silicon wafer processing technology.

Figure 1:
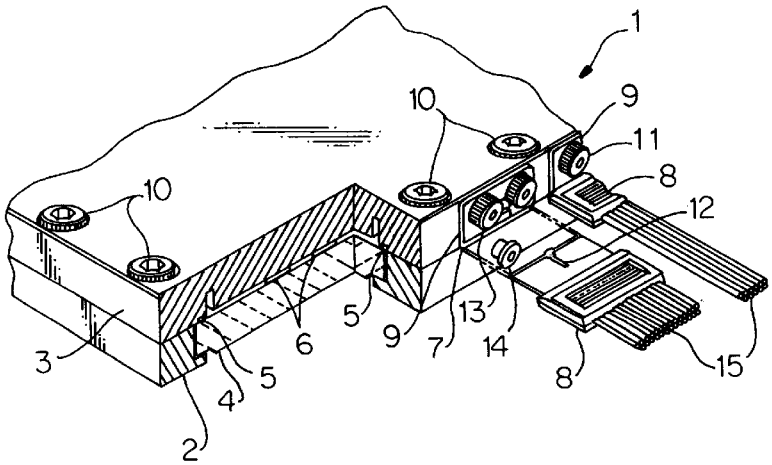
FIG. 1 is a cut-away perspective view of a thermal conduction module (TCM) illustrating a pluggable member of a connector system in mated and unmated positions.

FIG. 1 illustrates a partially sectioned TCM 1, comprising a lower frame 2, an upper frame with integral cold plate 3 that covers a multi-chip substrate 4 forming a protective enclosure when bolted together with seal 5 in place. Semiconductor chips 6, are in contact with the bottom surface of the integral cold plate 3. The aperture for receiving the pluggable contact cluster assembly 8 is formed by a well in the lower frame and reference surface of plug a lateral adjustment bracket 9, attached to the upper frame 3 by cap screws 11. Suitable alignment pins in the upper frame 3, not shown, will ensure the position of the aperture when the upper and lower frames are bolted together with bolts 10, spaced about the perimeter of frame members 2 and 3.

The reference surface of lateral adjustment bracket 9 has a protrusion 12A for engaging the guide slot 12 of the pluggable contact cluster assembly 8. Lateral adjustment of the right angle bracket 9 is accomplished by loosening cap screws 11, rotating eccentric cam 13 and retightening the cap screws 11. To engage the pluggable contact cluster assembly 8 to the embedded silicon contact actuation structure, not shown, contact cluster assembly 8 is inserted in slot 7 until it contacts the embedded silicon actuation structure. The radial segment cam 14 is then rotated an appropriate clockwise distance with a suitable tool. This completes the electrical path between the miniature semi-rigid coaxial cable group 15 and the internal wiring of the substrate.

Figure 2:
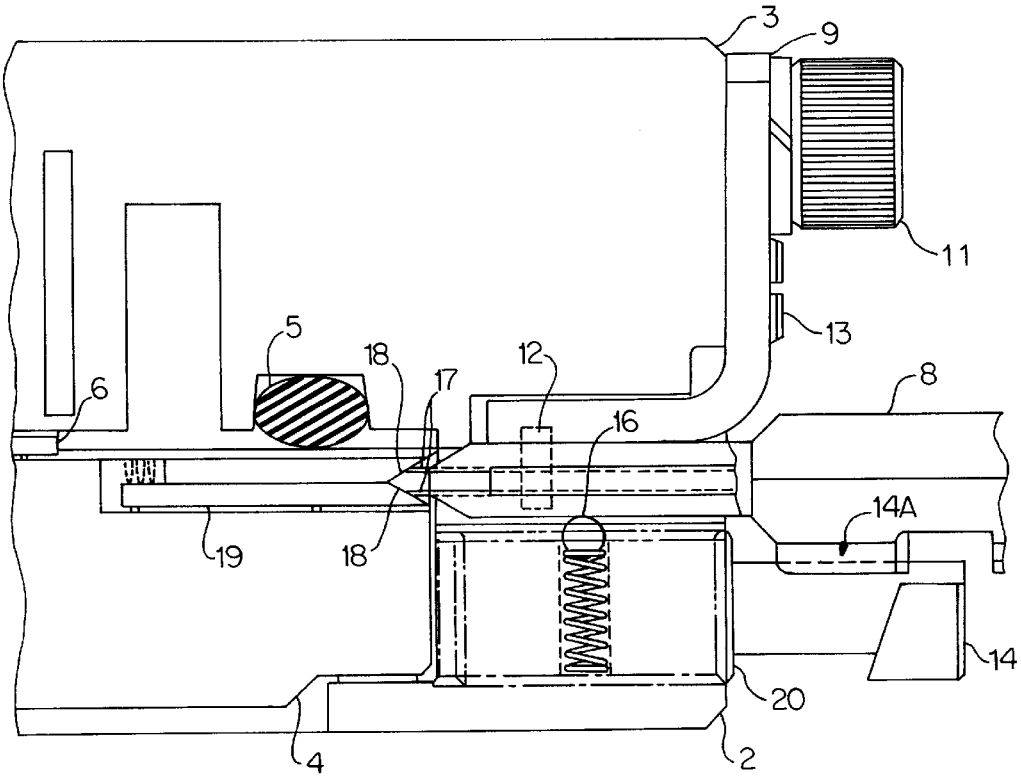
FIG. 2 is an enlarged cross-sectional view of mated connector members prior to full insertion by a cam actuation mechanism, part of the lower frame of the TCM.

FIG. 2 is an enlarged cross-sectional view of the connector system mounted in a TCM. During insertion of contact cluster assembly 8 in slot 7, a spring loaded ball 16 is compressed to force the forward part of the contact cluster assembly against the reference surface of bracket 9 and maintain engagement of the protrusion and guide slot 12. This aligns the bi-level cantilever plug contacts 17 with receptacle contact lands on the opposed angled edges 18 of the embedded silicon actuation structure 19 of the receptacle.

The radial cam segment 14 is captive in the threaded sleeve 20 so that it is free to rotate an appropriate radial distance.

Precise displacement of cam 14 relative to the opposed angled edges 18 is controlled by axial adjustment of the threaded sleeve 20 with a spanner tool. Rotation of the segment cam 14 clockwise forces the cantilever contacts 17 to deflect along angled edges 18. Radial segment cam 14 has a dwell region and small depression on its face to provide a detent which engages notch 14A in plug 8. Deflection of the cantilever contacts produces sufficient wipe and Hertz stresses to effect reliable separable connection.

Overriding the cam detent and returning the cam to its original position releases the cluster contact assembly for removal.

Figure 3A:
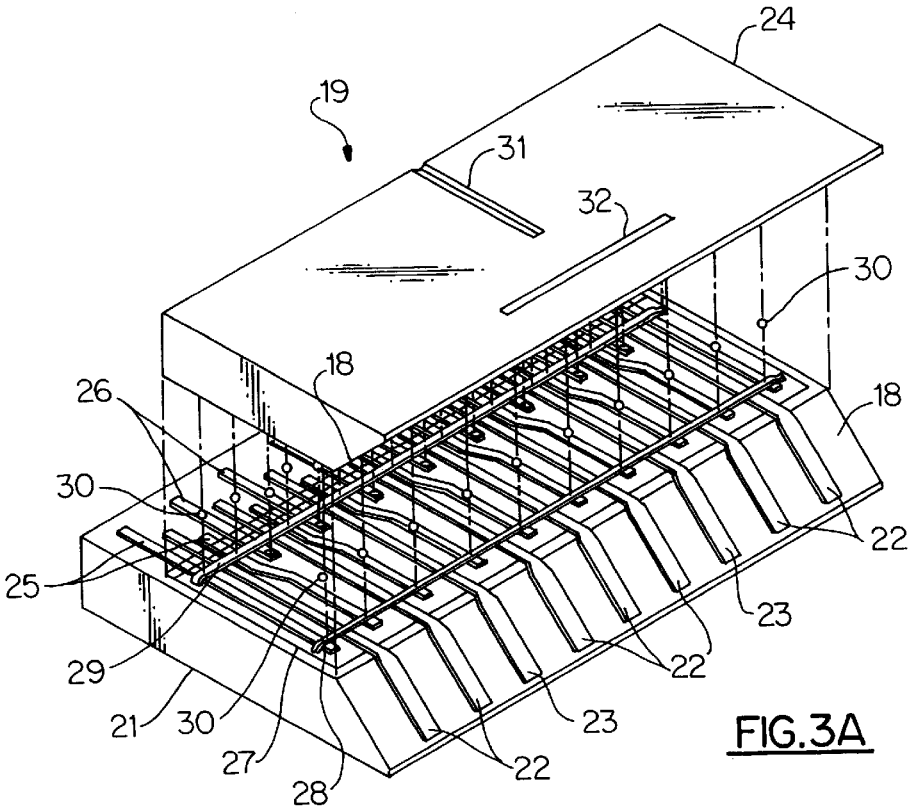
FIG. 3A shows an exploded view of the embedded silicon contact actuation structure.

FIG. 3A is an exploded view of the embedded silicon contact actuation structure 19. The structure is comprised of two silicon chips processed to provide a high density impedance matched electrical connector capable of being embedded and encapsulated as an integral part of a ceramic multi-chip module.

The lower silicon platform 21 has suitably spaced contact lands 22 and 23 disposed along angled edge 18. Similar contact lands are disposed along the angled edge of the upper silicon platform 24, except they are offset by 1/2 pitch. The 1/2 pitch offset between the opposed contact land sets permit cantilever contacts 17 to deflect along the lands to a common centrality without shorting to one another. The off-set also disposes a ground pathway directly opposite each signal land 22, so that when predetermined separation of platforms 21 and 24 by copper balls 30 is effected, a printed transmission line is achieved for all signal paths 22.

In FIG. 3A, lands 23 are ground contacts and 22 signals. Lands 22 and 23 extend to the rear of the lower platform 21. Ground reference paths 25 are disposed between paths 22 and 23 to minimize cross talk between signal paths 22. Lands 26 are used to transfer paths 22 and 23 from the underside of upper platform 24 to the surface and rear of platform 21 using copper balls 30.

Silicon platforms 21 and 24 are batch fabricated in a semiconductor line. Angled edges 18 are V-grooves preferentially etched to achieve a 57 degree sidewall angle. Contact lands 22 and 23 and other related wiring paths are photolithographically produced after the silicon surfaces are oxidized. A quartz or other suitable insulator 27 is then deposited over a selected area of the connector pattern. Openings are selectively formed in the quartz to permit connection to ground straps 28, 29 and copper balls 30. Ground straps 28 and 29 connect all ground reference elements 23 and 25. Wafers for platforms 21 and 24 must be processed on their opposite surfaces to produce alignment grooves 31 and 32 and a pad array under platform 24 for mounting the silicon assembly during embedment in the substrate. After dicing and placement of copper balls 30 and subsequent soldering to appropriate points on platform 21 and 24 the connector assembly is complete.

Copper ball bonding is performed using a eutectic alloy, 59% Gold/41% Indium, with a liquidus/solidus temperature of 494 deg C., well above subsequent process temperatures.

Figure 3B:
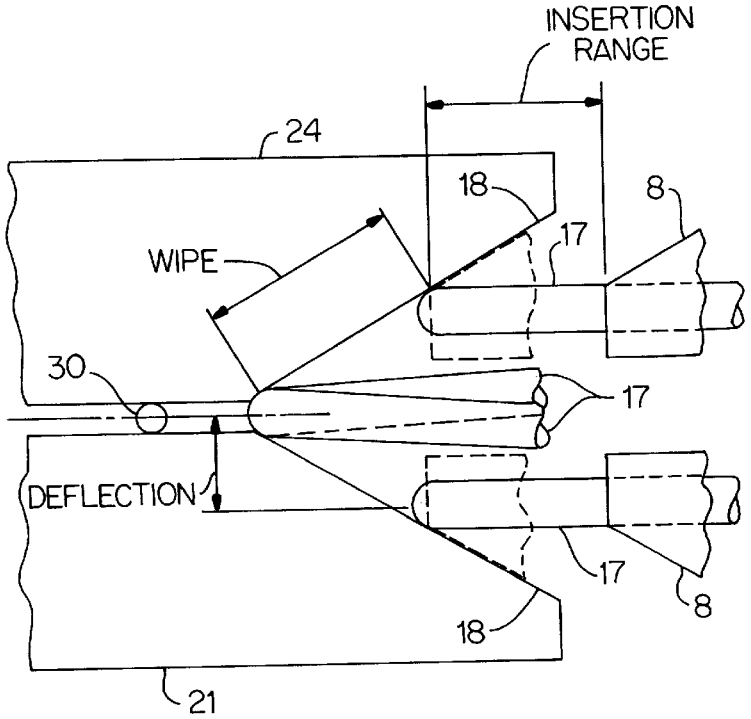
FIG. 3B shows the contact progression during its cammed operation.

FIG. 3B illustrates the initial contact of cantilever contactors 17 on angled edges 18. Also, displacement of contactors 17 to the center of the triangular opening formed by joined platforms 21 and 24, and the seating of the forward part of pluggable assembly 8 on opposed angled edges 18 limits contact insertion. Contacts 17 are made of Beryllium copper, suitably gold plated and may range in diameter from 5 to 8 mils. The Hertz stress for a 5 mil spherical end is too high, hence, the contact end of the beam will be upset to provide a cylindrical contact surface. The body of the cantilever member may also be selectively upset to a triangular shape so as not to require a larger V-groove for larger diameter cantilevers as well as orienting the cylindrical beam end. To provide the 10 mil deflection a 130 mil beam length would be required for the 5 mil diameter beam.

To maintain the same deflection range, an 8 mil diameter beam would have to have a length of 165 mils. Insertion force for a 33 contact cluster of 5 mil beams is 4.2 pounds, neglecting the frictional force component.

Figure 4:
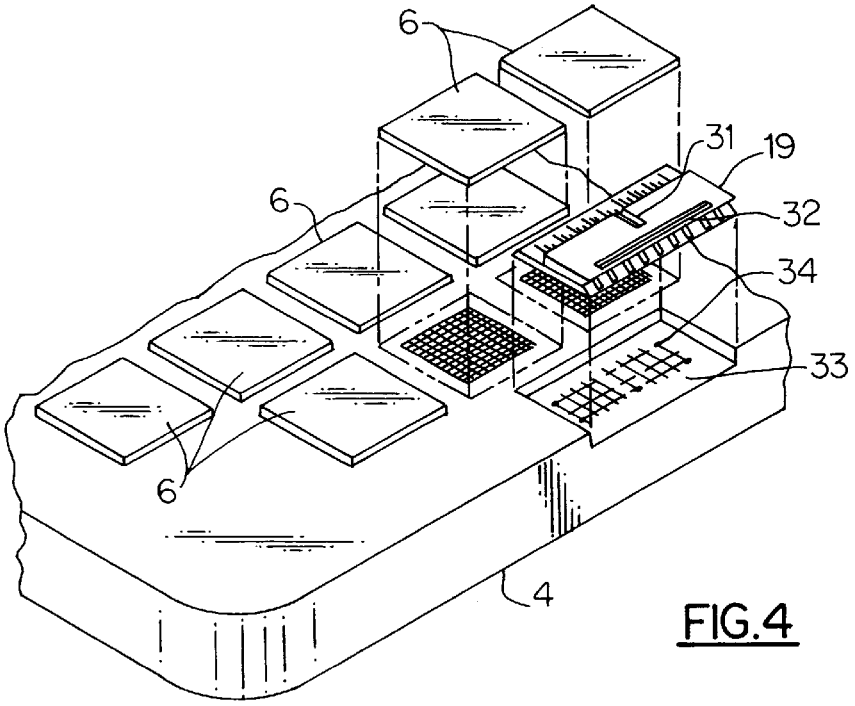
FIG. 4 shows an exploded view of the embedded silicon contact actuation structure and its respective well, located along the edge of a multilayer ceramic substrate.

FIG. 4 illustrates a partial exploded view of a substrate edge with a well 33 for containing the silicon actuation structure 19. Located at the bottom of the well 33 is a metal pad array 34 for reflow bonding to a corresponding pad array on the underside of silicon actuation structure 19. The solder alloy used is a eutectic 73% Gold/27% Indium with a liquidus/solidus temperature of 451 degrees Centigrade.

The well is created in the ceramic substrate 4 by punching an appropriate opening in the affected green sheets and filling the opening with a compatible slurry containing a particulate matter of a higher sintering temperature than the substrate composition, reference U.S. Pat. No. 4,301,324 by A. Kumar et al and assigned to IBM. The number of layers containing the non-sinterable openings is calculated to control the depth of the well desired after substrate planarization. The first sinterable layer below the stack of non-sinterable openings contains the punched and filled vias for the array of metal pads 34. After sintering, sizing and planarization of the substrate, the non-sinterable particulate material is removed from the cavity.

The silicon actuation structure 19 is registered and reflowed to pad array 34 at the bottom of well 33. During the reflow operation the alignment grooves 31 and 32 on the top surface of silicon actuation structure 19 are engaged by a vacuum assisted alignment tool and adjusted to proper registration with the C-4 array of the chip site pair along its edge. This positions the silicon actuation structure flush with the planarized surface of substrate 4 and aligns pads at the rear of lower silicon platform 21 with the thin film wiring via grid on the substrate surface.

After solidification of the Gold-Indium alloy to pads 34 a perimeter band is placed about the substrate to introduce sealing plugs into triangular openings formed by angled edges 18 of silicon contact actuation structure 19. With the plugs secured in place a polyamide resin is used to encapsulate the silicon contact actuation structure 19 and cured. The top surface is then subjected to a skim grind and polish operation to establish a final planarization of the top surface and the encapsulated regions.

Figure 5:
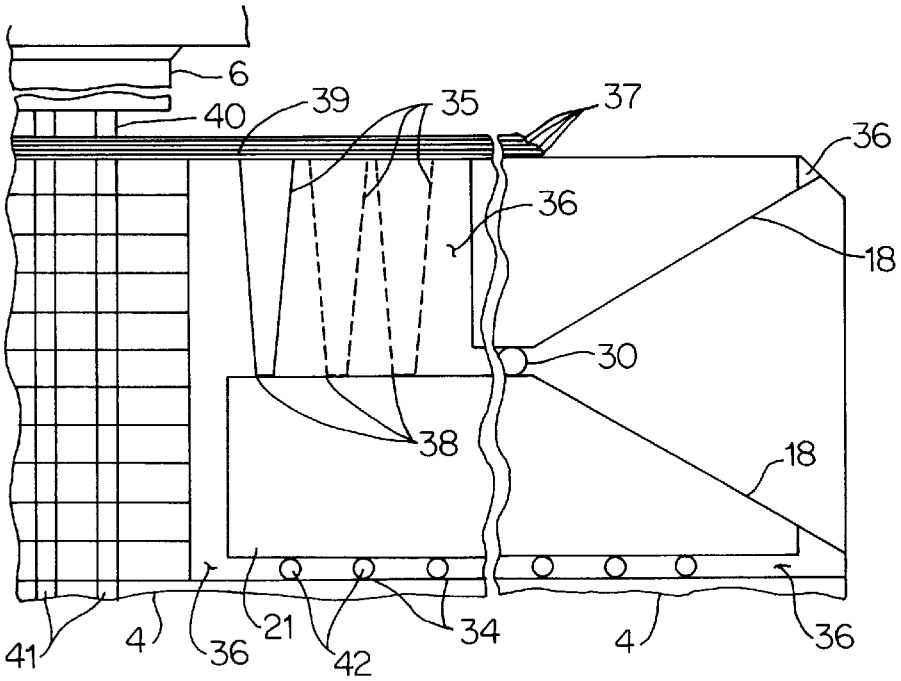
FIG. 5 is an enlarged partial cross-section of the embedded silicon contact actuation structure and method of interconnection to the substrate thin film wiring planes.

FIG. 5 is a partial cross-section of the embedded silicon contact actuation structure 19. Openings 35 are made through the polyamide encapsulant 36 using a laser ablation process. Openings 35 are located on the via grid of thin-film wiring 37 as well as engage pads 38 on the rear of the lower silicon platform 21 of silicon actuation structure 19. Metallization is deposited in the laser ablated openings to provide electrical paths from pads 38 on lower silicon platform 21 to pads 39 on the top surface of substrate 4. The multi-level polyamide thin-film wiring-layers 37 are then processed over the substrate top surface with connections to the pads 39 which are connected to pads 38 on lower silicon platform 21.

The thin-film wiring may then provide connections to C-4 40 of semiconductor chip 6, or stud via 41 of the multilayer ceramic substrate 4. Gold-Indium alloy 42 is shown connecting silicon contact actuation structure 19 to appropriate pads 34 located at the bottom of well 33.

Figure 6:
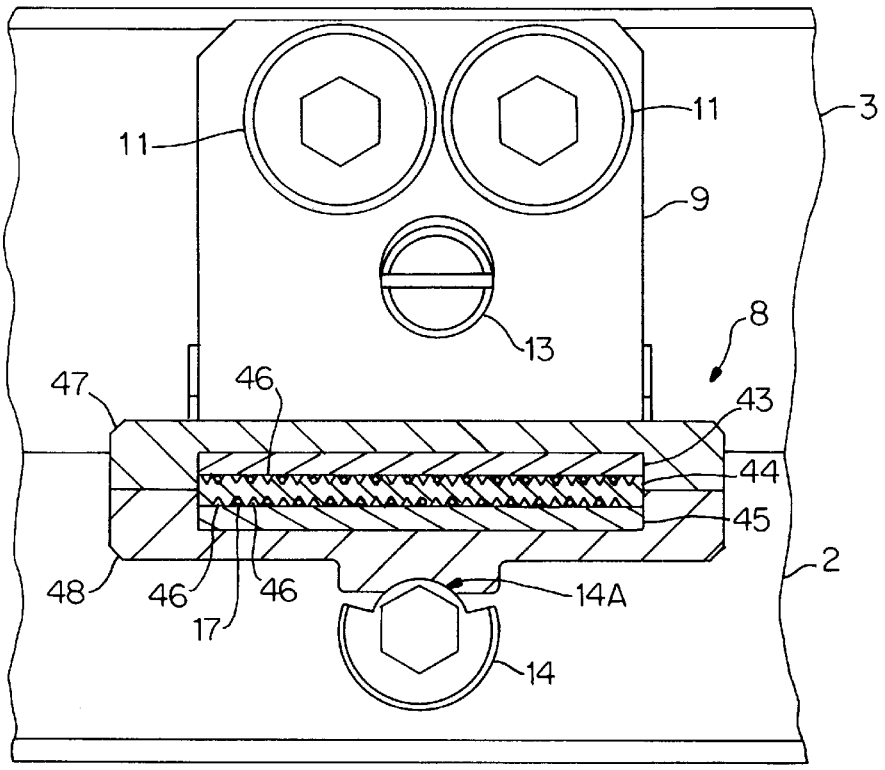
FIG. 6 is a partial cross-sectional elevation view of the pluggable connector portion of the connector system prior to final actuation by the cam member.

FIG. 6 illustrates a partial cross-sectional elevation view of pluggable connector system 8 prior to final actuation by cam member 14. Partial section of pluggable connector assembly 8 reveals the three stacked silicon members 43, 44 and 45 with two-tier cantilever contacts 17 disposed in a staggered configuration. Metallized V-grooves 46 are disposed between, as well as opposite, each contactor 17 to provide crosstalk and characteristic impedance control. Upper and lower plastic housings 47 and 48 are bonded together to contain, protect and provide stress relief for the connector elements. Notch 14A in pluggable connector 8 engages cam 14 to provide alignment of staggered cantilevered contacts 17 with receptacle signal lands 22 and 23.

Figure 7:
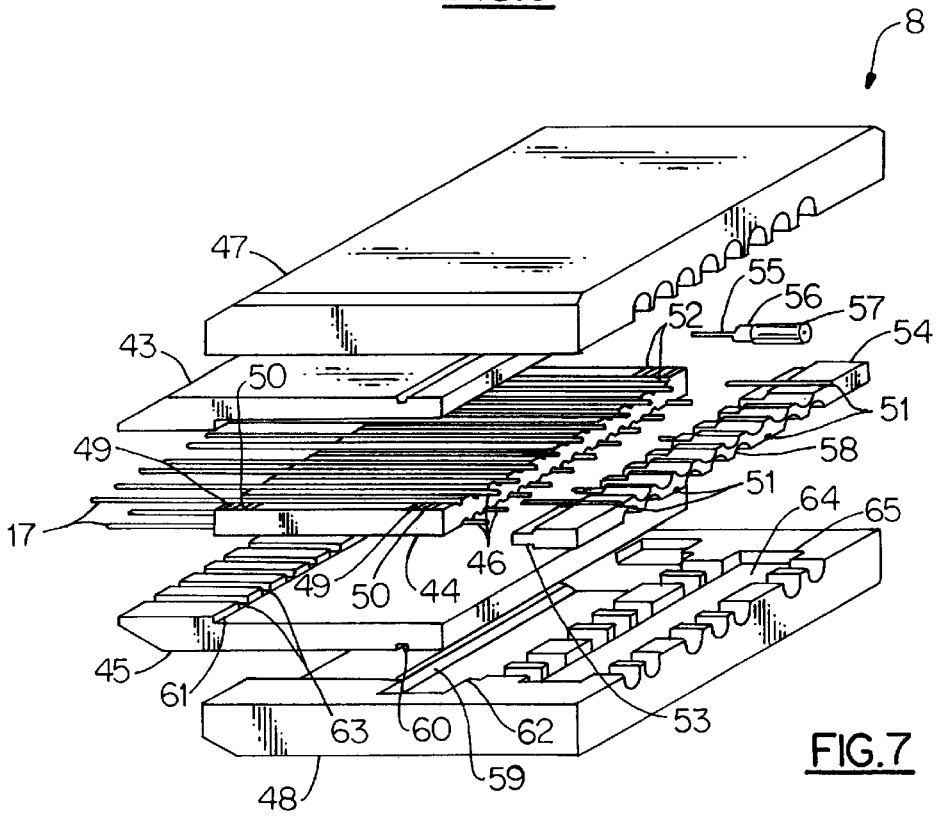
FIG. 7 shows an exploded view of the pluggable member of the connector system.

FIG. 7 illustrates an exploded isometric view of pluggable connector assembly 8 of the connector system. Silicon contact support member 44 is preferentially etched on both sides of a wafer to have V-grooves disposed in a staggered format. The wafer is then oxidized and V-grooves metallized. A quartz insulating strip 49 is deposited transverse to the V-grooves on both surfaces of the wafer. Openings are made in the quartz strip at each of the ground reference V-grooves 46. An electrically conductive strap 50 is deposited over the quartz strip connecting the alternately spaced ground reference V-grooves 46. Another quartz insulating strip 49 is deposited over the electrically conductive strap 50 and openings are made over the V-grooves aligned with grounding pins 51.

Individual silicon contact support members 44 are then diced from the wafer. Cantilever contacts 17 are located in appropriate V-grooves with ends a specified distance from the edge of silicon contact support member 44 and soldered in place. Simultaneously, ground pins 52 located in metallized ground reference V-grooves 46 are also soldered in place using the same solder alloy. Ground pins 51, 52 and center conductor 55 of the miniature semi-rigid coaxial cable are subsequently soldered to shelves 53 of metal cradle 54 and appropriate v-grooves in the silicon contact support member 44 with a lower melting point solder alloy. Outer conductor 57 of the semi-rigid coaxial cable and ground pins 51 were soldered to the metal cradle 54 with the same solder alloy used to solder cantilever pins 17. Concave grooves 58 are positioned to align the center conductor 55 of the semi-rigid coaxial cable with appropriate v-grooves in the silicon support member 44. The center conductor 55 is insulated by 56 from the outer conductor 57.

Lower silicon support member 45 is placed in lower plastic housing 48 so that rib 59 engages groove 60. Silicon contact support member 44 with attached metal cradle 54 and miniature semi-rigid coaxial cable group 17 is placed on the lower silicon support member 45 so that its front edge is constrained by step 61 of member 45. Cradle 54 ends are nested within wells 62 and contacts 17 are nested in v-grooves 63. The elastomer pad 64 in recess 65 is compressed about the outer shield 57 of miniature semi-rigid coaxial cables 17 when the upper silicon support member 43 and upper plastic housing 47 are assembled and bonded together.

It should be understood that the above-described embodiments of this invention are presented as examples and not as limitations. Modification may occur to those skilled in the art. Accordingly, the invention is not to be regarded as being limited by the embodiments disclosed herein, but as defined by the appended claims.

Having thus described our invention, what we claim as new and desire to secure by Letters Patent is:

1. A method of providing a pluggable receptacle in a module, comprising:

forming a notch in an edge of the module, forming a printed-circuit receptacle from two adjacent parts made of semiconductor materials, combining the parts to form an acute angle at one end of the receptacle, and the other end of the receptacle having one of the parts overhanging the other of the parts, selecting semiconductor materials having a coefficient of expansion similar to a coefficient of expansion of the module, depositing electrical contacts offset on the end of each part having the acute angle, and depositing electrically conducting wires on the adjacent parts to connect the electrical contacts to another end of the receptacle, bonding the receptacle in the notch to the module, connecting wires of the module to the electrically conducting wires at the overhanging end of the receptacle, surrounding the module with a frame supporting the module at least along edges of the module, and positioning a gas-tight seal between the module and an adjacent internal side in the frame, forming a plug opening in the frame in alignment with the receptacle to enable a plug to be inserted through the plug opening to mate electrical conductors of the plug with the electrical contacts of the receptacle, the plug supporting a cluster of electrical cables for engaging the electrical contacts in the receptacle, and filling all openings between the notch and the receptacle to prevent entry to a surface of the module of foreign matter through a plug opening in the frame whether the plug is disengaged or engaged with the receptacle.

2. A method of providing a pluggable receptacle for a module as defined in claim 1, further comprising:

connecting a large number of separate contacts in a receptacle to wires in the module, and the large number of separate contacts in the receptacle supporting a cluster of coaxial cables.

3. A method of providing a pluggable receptacle for a module as defined in claim 1, further comprising:

one or more sides of the module formed with a multiplicity of notches containing respective pluggable receptacles.

4. A method of providing a pluggable receptacle for a module as defined in claim 1, further comprising:

supporting an adjustment means in a notch in the frame to cam the plug in a lateral direction to enable precise alignment of electrical contacts in the plug relative to deposited contacts in the receptacle.

5. A method of providing a pluggable receptacle for a module as defined in claim 1, further comprising:

supporting a locking cam in the frame for forcing the plug into a locked position in the frame.

6. A method of providing a pluggable receptacle for a module as defined in claim 1, further comprising:

bonding the receptacle in the notch at the same time and with a same metallized bonding process as is used for bonding semiconductor chips to a surface of the module.

7. A pluggable receptacle for a module, comprising:

a ceramic module with at least one notch formed in an edge, a printed-circuit receptacle formed with two adjacent parts made of semiconductor materials bonded together in the notch to fill the notch flush with a surface of the module, the semiconductor materials having a coefficient of expansion similar to a coefficient of expansion of the module, a pluggable end of the receptacle formed with a projection for enabling the receptacle to receive an indentation in a mating plug to obtain an engagable alignment of electrical conductor pairs in the plug with contact pairs in the receptacle, the electrical contact pairs being deposited in an offset layout in a V-shaped groove on the pluggable end of the receptacle for bending offset electrical conductor pairs in a plug toward the apex of the V-shaped groove without electrical shorting as the plug is engaged with the receptacle, electrical connection means at another end of the receptacle for connecting the receptacle to wires of the module, a frame positioned around the module formed with a plug opening for receiving the plug, and a seal between an inner surface of the frame and a surface of the module to entirely seal a surface of the module from external contamination passing through the plug opening whether or not the plug is engaged with the receptacle.

8. A pluggable receptacle for a module as defined in claim 7, further comprising:

a connection end of the receptical opposite the pluggable end having one of the receptacle parts formed with an overhang relative to another part of the receptacle, and wiring means electrically connecting the connection end of the receptacle to wiring of the module.

9. A pluggable receptacle for a module as defined in claim 7, further comprising:

a lateral adjustment means supported in the frame having a side engagable with a plug inserted into the plug opening, and receptacle camming means for minutely moving the lateral adjustment means to force the plug laterally within the V-shaped groove of the receptacle for aligning conductor pairs protruding from the plug with the electrical contact pairs deposited in the V-shaped groove of the receptacle.

10. A pluggable receptacle for a module as defined in claim 9, further comprising:

locking means in the frame having a locked position in which the locking means forces and holds the plug against the lateral adjustment means to prevent disengagement of the plug from the receptacle until the locking means is put in an unlocked position.

11. A pluggable receptacle for a module as defined in claim 10, further comprising:

camming means separately providing the locking means and the lateral adjustment means.

12. A pluggable receptacle for a module as defined in claim 7, further comprising:

the electrical contact pairs of the receptacle being connected to wiring of one or more chips on the module.

13. A pluggable receptacle for a module as defined in claim 7, further comprising:

a multiplicity of receptacles being provided in one or more other sides of the module, and the receptacles being connected to wiring of one or more chips on the module.

14. A pluggable receptacle for a module as defined in claim 7, further comprising:

silicon materials being used to make the receptacle, and glass ceramic materials being used to make the module.

15. A pluggable receptacle for a module as defined in claim 7, further comprising:

silicon materials being used to make the receptacle, and alumina ceramic materials being used to make the module.

16. A pluggable receptacle for a module as defined in claim 7, further comprising:

a multiplicity of pins electrically connected to circuits in the module, and the pins extending outside of the module, and both the pins and the pluggable receptacles providing input/output connections to circuits assembled in and/or on the module.

* * * * *